US007252572B2

(12) United States Patent
Wright et al.

(10) Patent No.: US 7,252,572 B2
(45) Date of Patent: Aug. 7, 2007

(54) FIGURINES HAVING INTERACTIVE COMMUNICATION

(75) Inventors: Will Wright, Orinda, CA (US); Michael Winter, Orinda, CA (US); Matthew Sibigtroth, Berkeley, CA (US)

(73) Assignee: Stupid Fun Club, LLC, Berkeley, CA (US)

( * ) Notice: Subject to any disclaimer, the term of this patent is extended or adjusted under 35 U.S.C. 154(b) by 0 days.

(21) Appl. No.: 10/843,869

(22) Filed: May 12, 2004

(65) Prior Publication Data

US 2004/0259465 A1 Dec. 23, 2004

Related U.S. Application Data

(60) Provisional application No. 60/469,858, filed on May 12, 2003.

(51) Int. Cl.
*A63H 29/22* (2006.01)

(52) U.S. Cl. ..... 446/484; 446/297; 446/397

(58) Field of Classification Search ..... 446/175, 446/484, 302, 297, 298, 303, 485, 397; 463/1, 463/42, 43

See application file for complete search history.

(56) References Cited

U.S. PATENT DOCUMENTS

| | | | | |
|---|---|---|---|---|
| 6,089,942 | A * | 7/2000 | Chan | 446/175 |
| 6,110,000 | A * | 8/2000 | Ting | 446/302 |
| 6,526,158 | B1 * | 2/2003 | Goldberg | 382/115 |
| 6,634,949 | B1 * | 10/2003 | Briggs et al. | 463/42 |
| 6,690,673 | B1 * | 2/2004 | Jarvis | 370/401 |
| 6,729,934 | B1 * | 5/2004 | Driscoll et al. | 446/297 |
| 6,761,637 | B2 * | 7/2004 | Weston et al. | 463/42 |

* cited by examiner

*Primary Examiner*—Kien Nguyen
(74) *Attorney, Agent, or Firm*—J. D. Harriman

(57) ABSTRACT

The invention provides a method for figurines to form and join a network of figurines by setting them near other figurines, by activating them via a power switch, or by placing them in communication with a central hub. A communications path using radio or IR frequency is used to form the network, such that only one figurine can transmit data while the others receive data at any time. Once the network has been formed, the figurines can formulate behaviors based on the attributes, requests, and actions of the others. These behaviors are based on the data transpired between the figurines and can include meaning of spoken words, current state, etc. Each figurine has a personality controlled by its internal data, which also controls its relationships with others. Each figurine can spontaneously create a speech or action based on the reply given by another coupled with data stored within its databank.

10 Claims, 8 Drawing Sheets

FIGURINES HAVING INTERACTIVE COMMUNICATION

CROSS-REFERENCE TO RELATED APPLICATIONS

The present application claims the benefit of priority from U.S. Provisional Application No. 60/469,858 filed May 12, 2003, now abandoned which is herein incorporated by reference in its entirety.

BACKGROUND OF THE INVENTION

1. Field of the Invention

The present invention relates to the field of figurines, and in particular to a method for interactive communication between two or more figurines.

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all rights whatsoever.

2. Background Art

Figurines are collectibles or figurines that represent characters, fictional or real, human, plant, or animal. There have been a number of attempts in the past to make figurines that represent life like characteristics. For example, figurine dolls and other figurines have been created that eat, sleep, cry, laugh, speak, shoot, drive, swim, dance, and walk. Some figurines have been created to have some degree of interactivity with a user. For example, a stuffed bear known as "Teddy Ruxpin" seemed to interact with a user by telling stories, asking questions, and urging a user to touch, tickle, or squeeze various regions on the doll's body to provoke a response. Certain electronic toy dogs allegedly "learn" as they interact with an owner/user to do tricks and behave as trained by the user.

Existing figurines have had a number of disadvantages, including a limited ability of speech and an inability to interact with other figurines without direct input from a live user.

SUMMARY OF THE INVENTION

The embodiments of the present invention provide a method for figurines to form and join a network of figurines. In one embodiment, each figurine includes mechanisms for producing audible speech. In another embodiment, a hub is provided that provides all speech capability, and individual figurines include identifying characteristics so that speech is generated at the hub in response to the presence of specific figurines. In other embodiments, one figurine contains mechanisms similar to a hub so as to provide speech for itself and all other figurines.

According to one or more embodiments of the present invention, the figurines can form a network by setting them near other figurines capable of forming a network. The network is formed, for example, by facing two or more figurines at each other, by pointing them in the direction of other figurines, by activating the figurines via a power switch, or by placing them in communication with a central hub. A communication path using a radio or IR frequency may used to form the network. According to another embodiment of the present invention, a figurine can simultaneously be a member of more than one network, which means that the network communication transmission of a figurine can be either one-to-one or one-to-many depending on the number of networks the figurine belongs to, but there is a mechanism such that only one figurine can transmit data within a network while the rest receive at any given time. This is one embodiment of the invention, and other embodiments are contemplated where multiple overlapping data transmissions may occur.

According to another embodiment of the present invention, once a network has been formed, the figurines can formulate behaviors based on attributes, requests, and actions of the other figurines within the network. According to another embodiment of the present invention, the data transmitted between the figurines in a network consists of the meaning of spoken words, a description of the figurine's properties, the current psychological state of the figurines, and other data. In some cases, each figurine within the network has a personality controlled by its internal data located in a databank. Each figurine may have a table of relationships with the other figurines in the network. In one embodiment, a behavioral scoring algorithm within the figurine's databank assigns a score based on the mood and psychological state of the figurine, which governs the figurine's future behavior. According to another embodiment of the present invention, each figurine in the network can spontaneously create a speech or behavioral pattern based on the reply given by another figurine coupled with the data stored within its internal data.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

The embodiments of the present invention are a method for figurines to form and join a network of figurines. In the following description, numerous specific details are set forth to provide a more thorough description of embodiments of the invention. It will be apparent, however, to one skilled in the art, that the embodiments of the present invention may be practiced without these specific details. In other instances, well known features have not been described in detail so as not to obscure the invention.

Figurine

The figurines of the invention may represent real beings (for example, actors), fictitious characters (for example, super heroes and mythical gods), animated beings (for example, dolls), or inanimate objects (for example, cars and buildings). According to one embodiment of the present invention, figurines are able to formulate behaviors based on the attributes, requests, and actions of other figurines in a network. The behaviors include conversations, creating relationships, making sounds, controlling mechanical devices, running electronic processes, and connecting to computers and the Internet, to name a few.

The present invention contemplates a number of embodiments regarding a figurine, both active and passive. In one embodiment, the figurine is more self contained while in another, it is more cooperative and dependent.

Active Figurine

Figure 2:
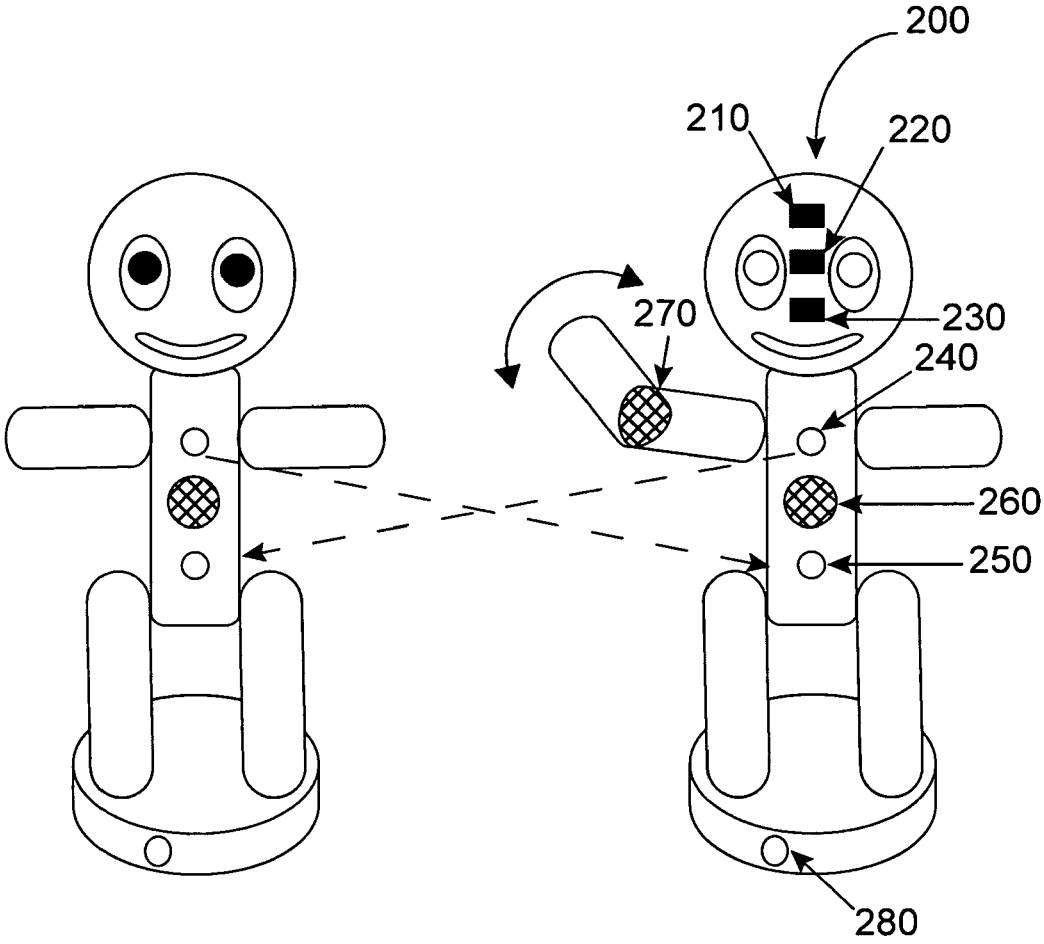
FIG. 2 is an illustration of a figurine, according to an embodiment of the present invention.

The present invention contemplates a figurine that is substantially self sufficient, meaning that it has power, processing, and audio capability. FIG. 2 is an illustration of figurine 200 with internal components that control the various interactions of the figurine with other members in a network. The figurine 200 includes storage media, a processing capability, sound generating circuitry, speaker, and network forming and communication capability. Module 210 represents the logic needed for communications, networking, forming groups, conversation, personalities and behaviors. The figurine 200 includes Internal Data RAM (220) for queues, relationship tables, traits, etc. Since there are items that change depending on the behavior of other members of a network, for example personality traits, items of interest, and textual databases, these are controlled by Internal Data ROM 230. The figurine also has other essential items like wireless communications transmitter 240, wireless communications receiver 250, speaker 260, and items such as a motor or actuator for mechanical effects 270, and a switch or sensor for user or environmental input 280.

Figure 3:
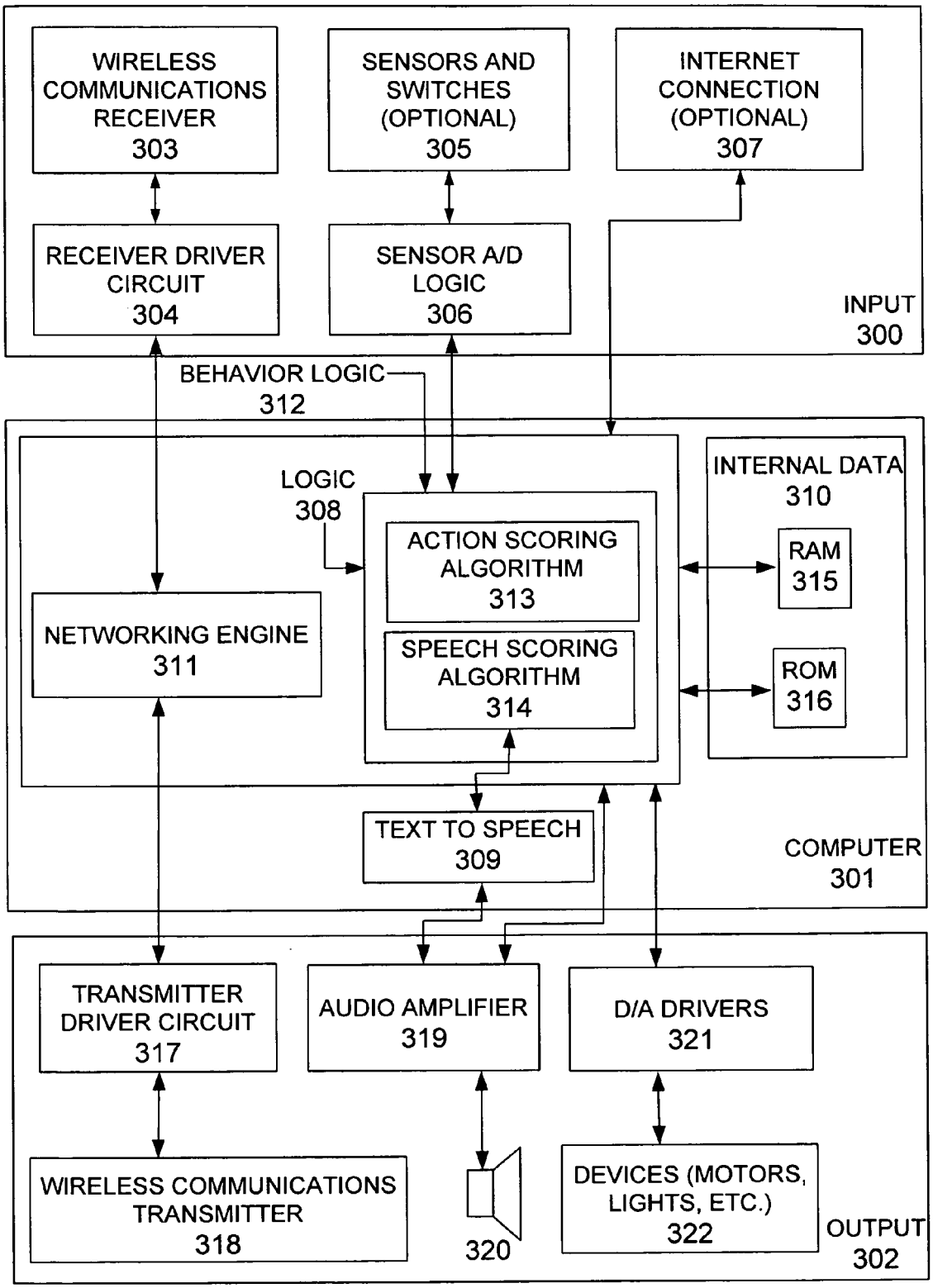
FIG. 3 is a block diagram of the various components and sub-components that make up a figurine and its functions, according to an embodiment of the present invention.

FIG. 3 is a block diagram of an embodiment of the various components and sub-components that make up a figurine such as figurine 200. The components include input 300, computer 301, and output 302. Input 300 is further divided into sub-sections, viz., a wireless communications receiver 303 in two-way communication with a receiver driver circuit 304, an optional collection of sensors and switches 305 in two-way communication with a sensor analog to digital (A/D) logic 306, and an optional Internet connection 307.

Computer 301 is further divided into sub-blocks, viz., logic 308, text to speech 309, and internal data 310. Logic 308 has a networking engine 311 in two-way communication on a first side with the receiver driver circuit 304, a transmitter driver circuit 317 on a second side, and behavior logic 312 on a third side. The behavior logic 312 consists of an action scoring algorithm 313 and a speech scoring algorithm 314, which is in a two-way communication with the text to speech component 309. The behavior logic 312 is in a two-way communication with internal data 310. Internal data 310 contains RAM 315 and ROM 316. RAM 315 is responsible for controlling and monitoring the mental state of the figurine, the sent and received message queues, the to-do queues, recent history, the relationship table, and other miscellaneous duties. ROM 316, on the other hand, is responsible for controlling and monitoring character identification, personality traits, textual database, items of interest, and other miscellaneous duties.

Output 302 contains various separate components, and is not limited to, a transmitter driver circuit 317 in a two-way communication with a wireless communications transmitter 318, an audio amplifier 319 in a two-way communication with logic 308 and text to speech 309 on a first side and with speaker 320 on a second side, various D/A drivers 321 in a two-way communication with logic 308 on a first side and with various devices such as motors, lights, etc. 322 on a second side.

Passive Figurine

In another embodiment of the invention, figurines are referred to as "passive" in that they do not include, for example, audio capability. A passive figurine includes a "tag" of some sort that represents the figurine's "DNA", i.e. its name, identity, personality, etc. The tag may be implemented in a number of ways. For example, the tag could be an automatically detectable device such as an RFID (radio frequency identification) device. The tag could also be an infrared device, electronic transmitter, scannable barcode, or even a molecular barcode. In other embodiments, the tag may be a unique identifier that is manually provided to an active receiver to initiate activity or network formation.

Hub and Spoke

In one embodiment of the invention, such as, for example, where passive figurines are used, a central hub is provided that contains processing, memory, and audio visual capability for all figurines that will interact with it. A play set can be used that includes a hub with a plurality of spokes physically connected to the hub and with known positions. In other embodiments, the spokes are in some form of communication with the hub (i.e. electrical, optical, etc) such that when a figurine is placed on any of the spoke locations, the hub is aware of both its presence, and, via its tag, the identity of the figurine.

Figure 5:
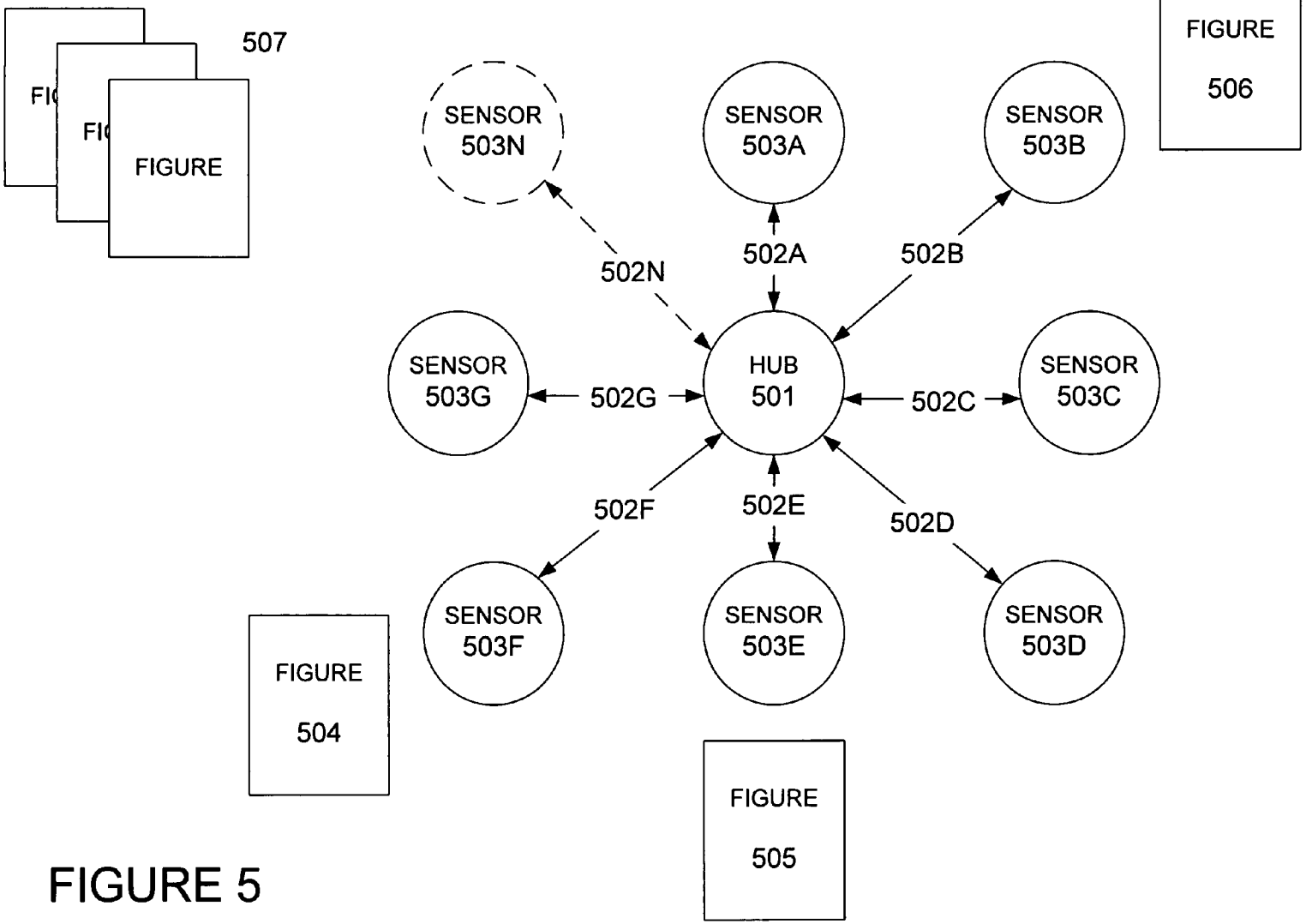
FIG. 5 is a diagram of a hub/spoke embodiment of the invention.

An example of such a hub/spoke assembly is illustrated in FIG. 5. A hub 501 is connected to a plurality of spokes 502A–502N. At the end of each spoke 502 is a sensor 503 (sensors 503A–503N). When a figurine, such as figurine 504, is placed on a sensor, the hub 501 detects its presence and responds both to the unique ID of the figurine and, in some cases, to the particular sensor location 503 on which the figurine is placed. Although FIG. 5 shows a circular and symmetrical hub and spoke assembly, the present invention is not limited to such a configuration. The configuration may be of any type, so long as there is some path for communication from the sensor 503 to the hub 501 via a physical or virtual spoke 502.

Figure 6:
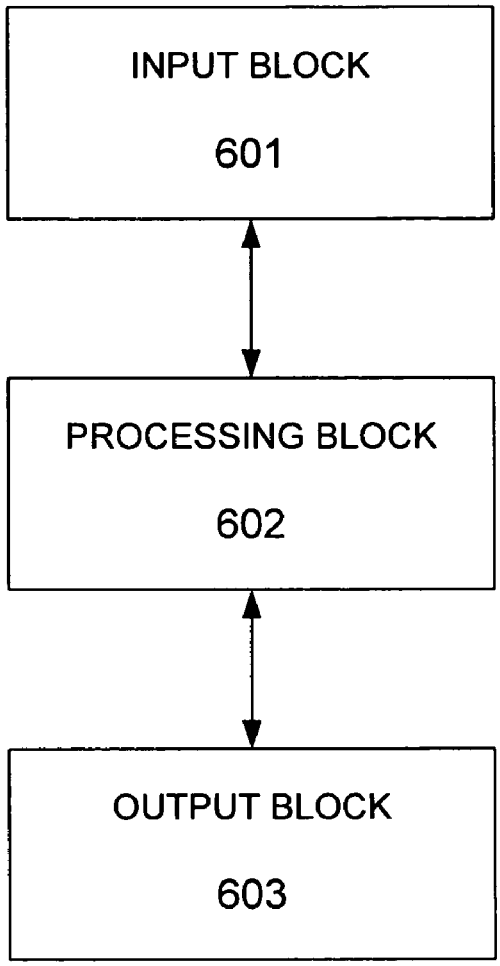
FIG. 6 is a functional block diagram of a hub.

The hub 501 is comprised of similar hardware as the active figurine of FIG. 3. A block diagram of the hub architecture is illustrated in FIG. 6. The hub 501 includes an input block 601 that is coupled physically or virtually to sensors of the spokes. The input block 601 is used to detect the presence and identity of a figurine placed on a sensor. The input block includes sensors depending on the type of tag used in the figurine. A processing block 602 includes computer processing power, program storage, and data storage for a plurality of figurines. An output block 603 provides the ability to present output to users of the system, including, for example, audio, video, devices, etc. The hub includes storage and processing for a plurality of figurines so that the functionality of an active figurine is duplicated in the hub. Interaction between figurines is still accomplished, but all speech and processing takes place in a central location.

Figure 7:
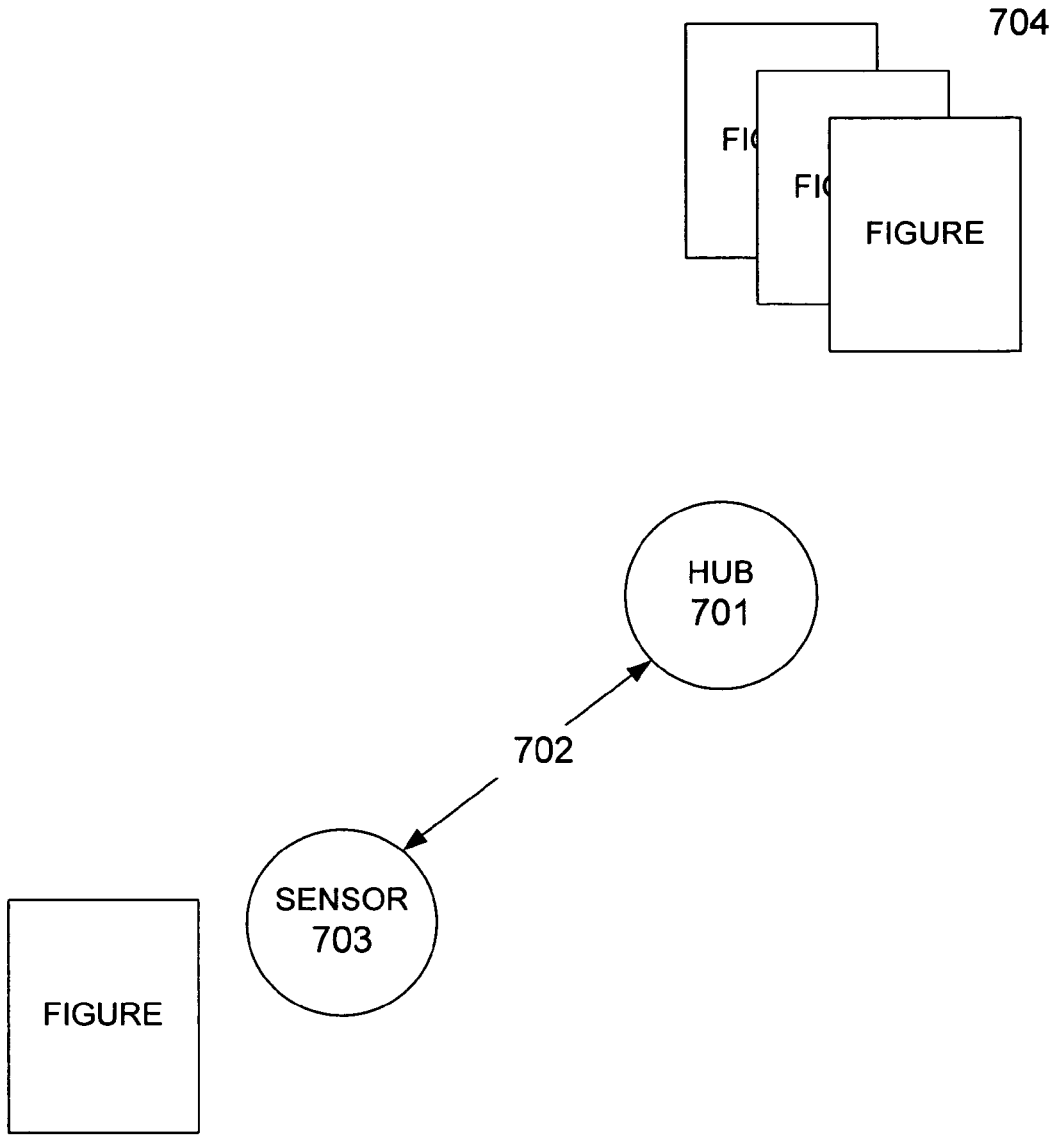
FIG. 7 is a diagram of a single spoke hub/spoke embodiment.

Another example of a hub and spoke assembly is illustrated in FIG. 7. In this embodiment, there is only a single spoke 702 from hub 701. The spoke 702 connects a single sensor 703 to hub 701. A user may have one or more figurines such as shown by plurality of figurines 704. The figurines are activated by placing them one at a time on the sensor. This may be done randomly, in response to a request from the hub, or pursuant to a story or game.

Network Formation

One aspect of the invention, regardless of whether active or passive figurines are used, is the formation of a network. This refers to the initiation or continuation of interaction between one or more figurines. It should be noted that networks are not limited to figurines all of one type. It is contemplated that interactions and networks of mixed active/passive pairs or groups of figurines is possible. Even solo activity of a single figurine is considered to be within this description of network formation (e.g. with the single hub/spoke of FIG. 7).

According to one embodiment of the present invention, a figurine can automatically form and join a network with user interaction to the extent of placing the figurine close to other figurines capable of network formation, by facing the figurine or pointing it towards another figurine capable of network formation, or by placing it on a sensor of a hub assembly. According to another embodiment of the present invention, the user can activate the formation of a network by pressing a button on the figurine, which may be a power switch. According to another embodiment of the present invention, the figurine can create and be a part of more than one network.

Figure 1:
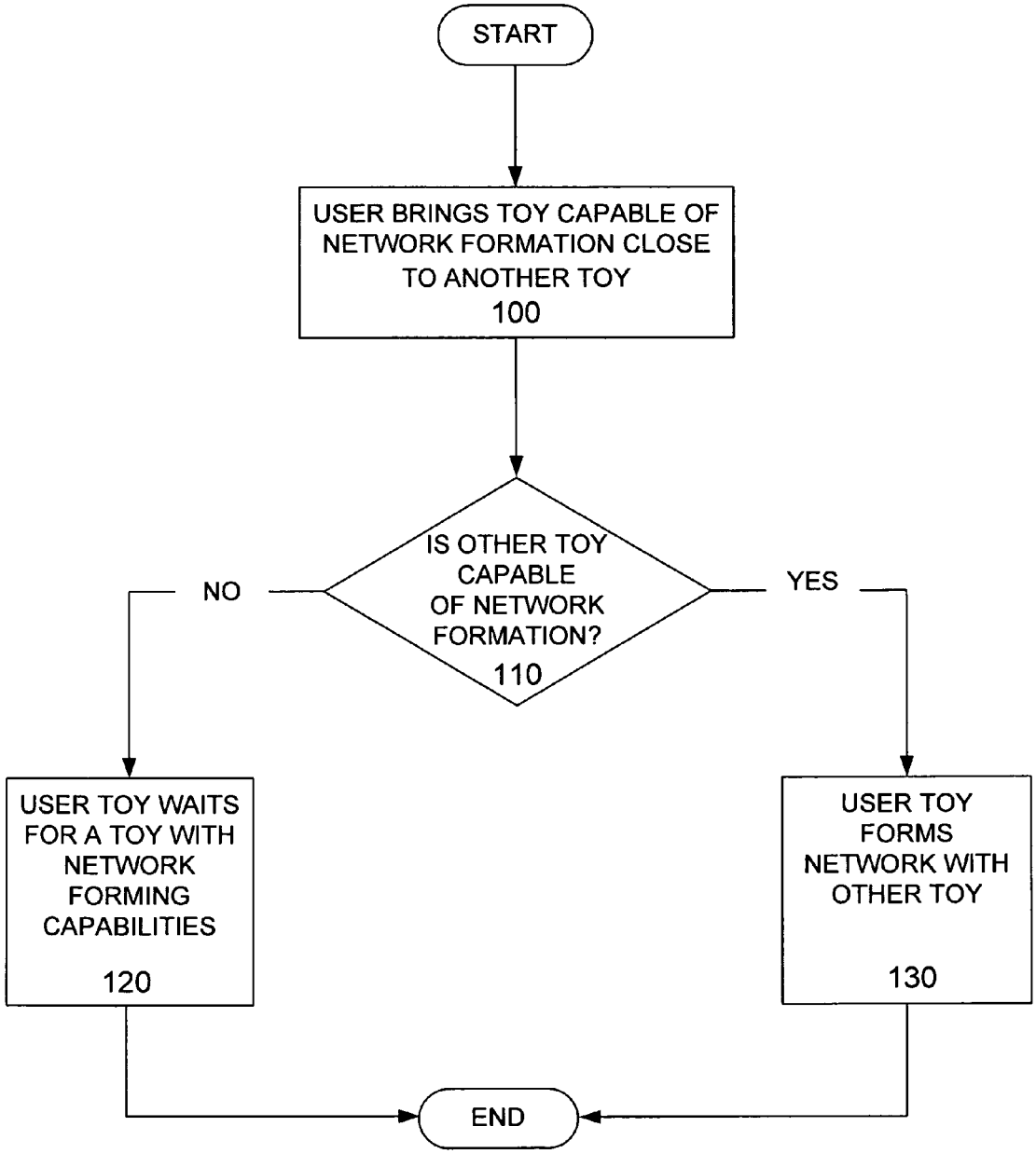
FIG. 1 illustrates the formation of a network, according to an embodiment of the present invention.

FIG. 1 illustrates the formation of a network. At step 100, a user joins a network by, for example, moving a figurine capable of forming and joining a network of figurines close to another figurine by either facing or pointing the figurine towards the other figurine, or by placing the figurine on a sensor. At step 110, a check is made to see if the other figurine is capable of forming and joining the network. If it is not (the "no" branch), then the user figurine waits for another figurine with network forming capabilities at step 120. If, on the other hand, the other figurine has the capability to form and join a network (the "yes" branch), then at step 130 the user figurine forms a network with the other figurine.

Network Communication Methods

According to one embodiment of the present invention, a figurine uses infra-red (IR) technology as a physical communications method to communicate with other figurines in the network. According to another embodiment of the present invention, the figurine uses radio frequency to communicate with other figurines within the network. In another embodiment, the communication is via the hub and spoke environment, where communication is via the hub.

According to another embodiment of the present invention, these methods allow the figurines to communicate with each other verbally (via speech and sound) or non-verbally, via actions, which can range from a hand wave to symbolize a "hello" to the stomping of feet to symbolize "annoyance". According to another embodiment of the present invention, a figurine can use one communications method to form one network and another method to form another network.

It should be understood that in the case of passive figurines in the hub/spoke assembly, all audio communication comes from a single source, i.e. the hub. However, the hub is capable of producing speech for a plurality of characters with different voice tones for each figurine. Thus, two or more figurines can seem to be "talking" to each other even though all of the sound is produced by a single source.

According to another embodiment of the present invention, the network communication transmission is one-to-one. This means that a figurine can communicate with another figurine from within the same network. According to another embodiment of the present invention, the network communication transmission is one-to-many. This means that a figurine can communicate with more than one figurine which may or may not belong to the same network.

In some cases, multiple data transmissions may occur simultaneously or in an overlapping manner. According to one embodiment of the present invention, the mechanism is a software trigger to signal the end of a logical sentence or conversation so that the listening figurine may respond, or the end of a logical motion like a body movement so that the other figurine may respond accordingly.

Figurine Interaction and Use

There are a number of ways in which the figurines can be used in the present invention. Consider a set of figurines that include characters named Andy, Bob, Charlie, and Dave. As is explained more fully below, each character has a different personality, mood, vocabulary, interests, and relationships. When Andy and Bob are in network communication with each other, they begin "speaking" to each other. The conversation can be tentative, if they are meeting for the first time, or familiar, if they have had previous interaction. Andy may ask questions of Bob such as "What is your name", "What do you like to do", etc. and wait for answers. The conversations are spoken aloud for the enjoyment of the user. In addition, data is sent back and forth between the figurines to indicate what is being said so that an appropriate response can be generated. Andy and Bob may tell jokes to each other, one or both may tell a story, or they may even insult each other, all depending on their coded personalities and relationships. Charlie and Dave can also join in the network and join in the conversation. The figurines may have a group conversation, two or more one on one conversations, or may ignore a figurine entirely. The figurines may even borrow "money" from each other. The money is virtual but each figurine can keep track of its own accounts. Money owed or borrowed from another figurine is a factor that can affect the relationship and verbal interaction between figurines.

In other embodiments, the play may be more structured. For example, one figurine, or the hub may direct interaction with one or more figurines by following a scripted story, playing a game with rules, or by requesting the user to answer questions by introducing various figurines into the network. For example, the sensors in a hub/spoke assembly can be uniquely marked. Overlays or game boards can be used with the sensors and the user can be directed to move figurines on and off certain sensors to accomplish a goal, play a game, further a story, etc.

The use of the figurines of the present invention can also provide an enhanced experience with traditional and existing games. For example, figurines can be created to play a detective game that takes place in a house. A hub spoke assembly corresponding to the rooms of the house can be provided and the user or users can play a detective game by manipulating the figurines.

A fantasy role playing game can also be enhanced by the figurines of the present invention. The hub can take the place of a rule book and record keeper. Data for characters is kept in the hub memory and accessed when that figurine is involved. Complex rules for interactions between characters can be handled automatically, resulting in a streamlined but more realistic game playing experience.

Internal Data

According to one embodiment of the present invention, each member of a network is capable of individualizing its personality that controls the behavior that the figurine wants to do next. This personality is defined in its Internal Data. The Internal Data may include such traits as: mental states (happiness, sadness, etc.), sent-message queues, received-message queues, to-do queues, recent history, figurine relationship table (knowing specific figurines), character identification (frog 123, or teen doll 420), personality traits ("I am a classy frog"), items of interest ("I like flies"), and other data. It is understood that for active figurines, this data is stored within each figurine. For passive figurines, the Internal Data for all figurines is stored in the hub.

Data Structure/Relationship Table

The personality of each figurine is kept in a data table stored in or associated with each figurine. An example of a figurine data structure is illustrated below in Table I:

TABLE I

| Static Traits | Inquiry | Insult | Compliment | Joke | Banal | Query | Story | Gossip |
|---|---|---|---|---|---|---|---|---|
| | 7 | −4 | 8 | 6 | 2 | 7 | −5 | −3 |
| Dynamic Traits | Health | Money | Happiness | | | | | |
| | 7 | −9 | 10 | | | | | |
| Likes | | | | | | | | |

The static traits of a particular figurine establish certain characteristics and personalities of the figurine. The categories shown above are given by way of example only and could be added to, changed, or reduced without departing from the scope of the invention. In one embodiment, static traits are given scores from −10 to 10, permitting thousands of unique personalities available for figurines. For example, a high compliment value will cause a figurine to give more compliments to other figurines.

The dynamic traits of a figurine are changed based on game play and/or interaction with other figurines. For example, it is contemplated that figurines will conduct financial transactions with each other, pursuant to some game play rules, or with a hub controller. Thus one dynamic trait shown above is "money". Health and Happiness are other dynamic traits that can change during conversations and game play.

The Likes of a figurine are stored as associators consisting of classes and instances. Each instance may be scored (e.g. from −100 to 100) to further fine tune and represent the personality of the figurine. An example of a class is Food, with instances of pizza, ice cream, cookies, vegetables, etc. Another class may be colors with instances of individual colors. In one embodiment of the invention, new instances and classes may be added by game play and/or interaction and conversation. This is accomplished by other figurines or the hub transmitting new data to a figurine or to the data file of a figurine.

According to one embodiment of the present invention, a figurine relationship table contains a list of other figurines in the network and a description of their relationships with the figurine. For example, a figurine may like a superhero who just joined the network recently, but may be tired and bored by a clown who is a founding member of the network.

An example of a relationship table is illustrated below in Table II:

TABLE II

| | Relationship Values | Attraction | Likes Match | Others Likes | Last Message | Greeting |
|---|---|---|---|---|---|---|
| FIG. A | −7 | 9 | 5 | Associators Class/ instance | 11 min. | 1 |
| FIG. B | 8 | 6 | 7 | | 4 sec | 1 |
| FIG. N | 4 | 5 | 5 | | never | 0 |

The Relationship Value indicates how much this figurine (whose table this is) likes another figurine found in its relationship table. The table can be prepopulated with all possible figurines or can be dynamically created as a figurine meets, interacts with, or learns about, other figurines. In one embodiment, the Relationships Table is populated only with the data of other figurines presently in a network with this figurine. In other cases, the data may be always available but a presence/absence flag indicates which other figurines are available for direct interaction.

The Attraction score indicates how much this figurine is attracted to another figurine and is represented, for example, by a score from −10 to 10. The Likes Match indicates how closely the likes of this figurine match up with other figurines in the table. Others Likes may be similar to the Likes entry of the data structure of this figurine, but stores the Likes of other figurines that this figurine has met. This data may be stored in this relationship table or may be accessible by this figurine so that it can tailor conversation more appropriately, either by talking about common likes or by introducing new likes to the other figurines. The Last Message entry indicates the last communication from the other figurine and can be used as a factor in initiating or continuing conversation. This can also impact dynamic traits of this figurine. The Greeting entry indicates whether this figurine has greeted the other figurines.

According to another embodiment of the present invention, in order to be able to change a behavior depending on the mood, the figurine is capable of periodically determining a behavior it wants to do next. According to one embodiment of the present invention, this is accomplished using a behavior scoring algorithm that analyzes the internal data and assigns a behavior score. Typical behaviors include, but not limited to, speech, making sounds, updating of the internal data, and making mechanical motions.

Transmitted Data/Figurine Behavior

Transmitted data can include, and is not limited to, an explanation of the figurine's spoken words (for example, the meaning of a joke), a description of the figurine's properties (for example, if the figurine is a frog then the data may include features and characteristics of a frog), the figurine's current state (for example, the current mood of the figurine), and commands to other figurines (for example, "you must laugh").

According to one embodiment of the present invention, the spontaneous creation by a figurine of unique and relevant speeches is one of the many figurine behaviors. The contents of a speech are created by a speech scoring algorithm, which selects what to say based on the internal data of the figurine and on what phrases are available in the text database. According to another embodiment of the present invention, the phrases in the text database are marked-up with usage, keywords, and other descriptive data. This allows the figurine, using its speech scoring algorithm, to select the most appropriate phrase for a given situation. For example, the phrase "Hello there" is marked up as a 'greeting' that could be used when first encountering another figurine. According to another embodiment of the present invention, other phrases are in the form of templates that may be a combination of literal text and placeholders. By replacing the placeholders with words from a database, a new and meaningful phrase can be created. For example, one figurine may say "My name is Butch", and another figurine might respond using the "Good to meet you NAME" template, where "Butch" would be substituted for 'NAME'. According to another embodiment of the present invention, a figurine may use more than one placeholder in a sentence or conversation. An example of a personality sheet and phrases for a figurine is shown in Table III further below.

It is to be understood that the invention is not limited to pregenerated or prerecorded phrases. An embodiment of the invention uses text-to-speech generation techniques to output conversational sentences. Using templates, word substitution and/or phrase substitution, new phrases can be generated and spoken using text-to-speech. In some embodiments, these phrases are a function of the context of the speech or of the figurines involved in the speech. In some cases, one figurine may transmit a vocabulary to another figurine to allow that figurine to customize its speech with the first figurine. In addition, by interacting with more figurines, the vocabulary of a figurine can grow over time.

In addition, the database of a figurine may include a "diphone" table which comprises a number of single or linked phonemes. Pitch, tone, mood, and other modifiers may be used to adjust the speech of a figurine for context and to indicate emotional state of the figurine. The result is that identical sentences can have different meanings by modifying the pitch and attitude of the spoken words. What may be informational in one context could be sarcastic when spoken in a different way.

Figure 4A:
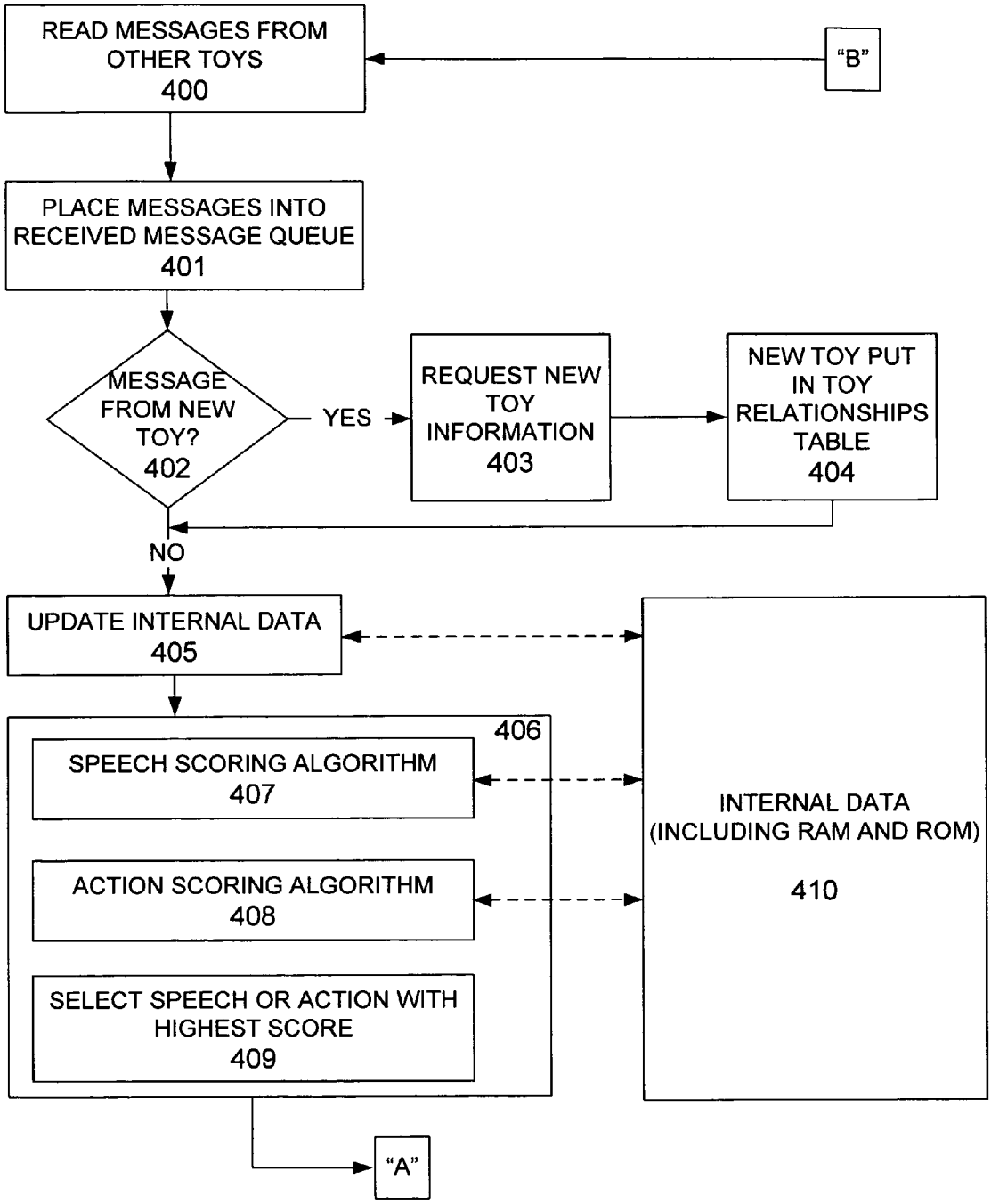
FIG. 4 is a flowchart that illustrates the operation of a figurine to form and join a network, according to an embodiment of the present invention.
Figure 4B:
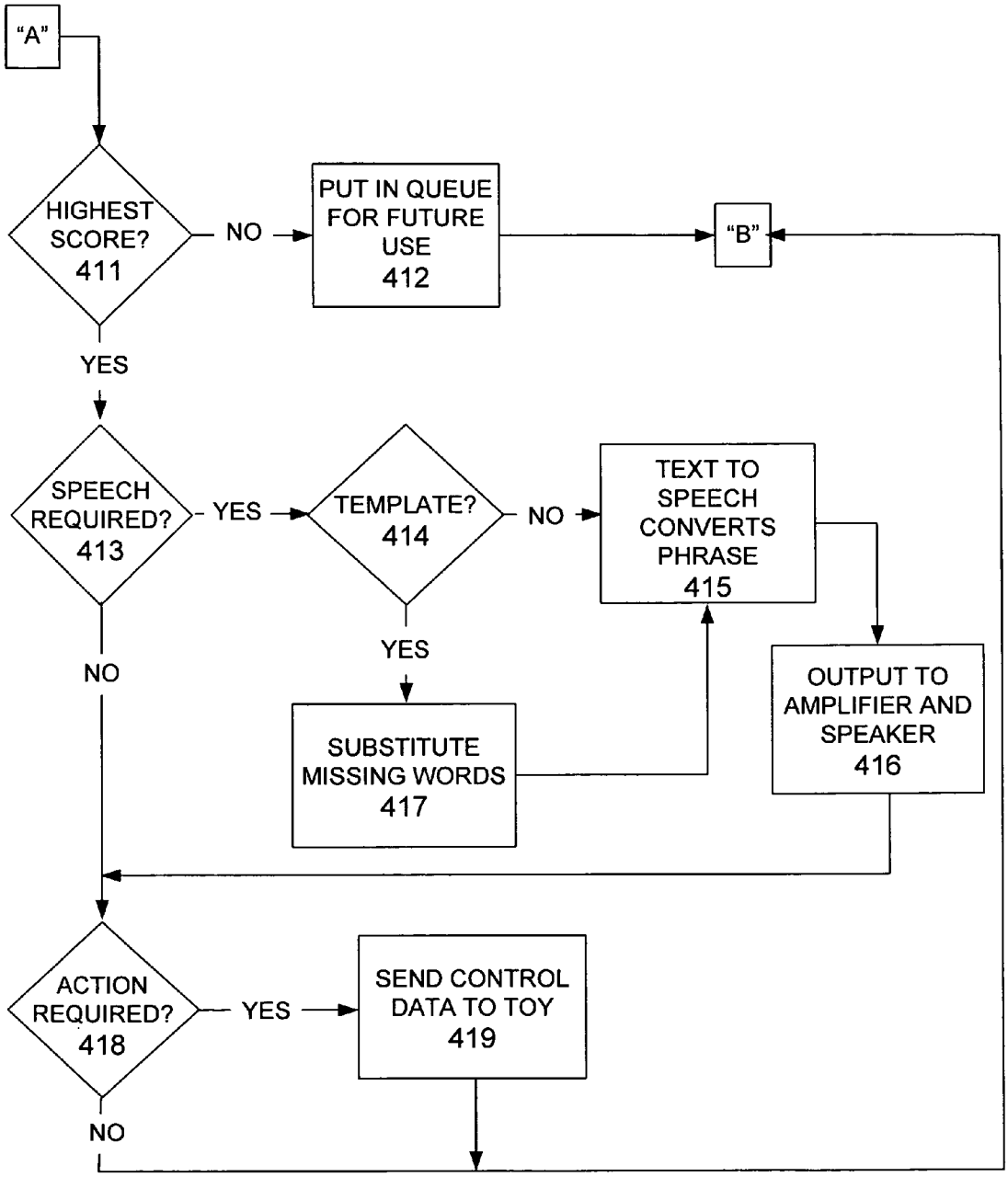

FIG. 4 is a flow diagram that illustrates the steps used by a figurine to form and join a network. At step 400, messages are read from the network (other figurines). At step 401, the read messages are placed into a received-messages queue. At step 402, a check is made to see if there is a message from a new figurine. If there is a message (the "yes" branch), then at step 403 a request is sent to the new figurine for figurine description and other data. At step 404, the new figurine is added to the figurine relationships table, and the software moves to step 405. If, on the other hand, there is no message at step 402 (the "no" branch), then at step 405 the figurine updates its internal data based on recent events.

In order to update the internal data, the figurine uses the RAM and ROM components at step 410. Next, at step 406 (which contains steps 407–409) the behavior scoring algorithm is run. In order to run the behavior scoring algorithm, the figurine uses a speech scoring algorithm 407, and an action scoring algorithm 408, both of which use RAM and ROM components 410. At step 409, the figurine chooses an action or speech having the highest score. Next, at step 411, a comparison is made between the figurine's highest score and the highest score of others in the network. If the score of the figurine is not the highest in the network (the "no" branch), then at step 412 the figurine is put in a queue for future use, and the software goes back to reading messages from other figurines in the network at step 400.

If, on the other hand, the score is the highest (the "yes" branch), then at step 413 a check is made to see if speech is required. If speech is required (the "yes" branch), then at step 414 another check is made to see if there is a template available for the speech. If a template is available (the "yes" branch), then at step 417 the missing word(s) are substituted before going to step 415. If, on the other hand, there is no template available (the "no" branch), then at step 415 the text to speech component converts the phrase to an analog format. Next, at step 416, the speech is outputted to an amplifier and speaker before going to step 418. If, at step 413, there is no speech required (the "no" branch), then at step 418 another check is made to see if there is any action required. If there is one required (the "yes" branch), then at step 419 a control data is sent to the device before going back to step 400 to listen for new messages from other figurines in the network. If, on the other hand, there is no action required (the "no" branch), then the software goes back to step 400 to listen for new messages from other figurines in the network.

In one embodiment, the speech scoring algorithm looks at a number of factors. First the figurine looks at whether any immediate needs exist. For example, if the figurine urgently needs money, has very low health, or if someone has just joined the network and been detected, an immediate need exists for the figurine to communicate. Other indicators would be if another figurine has just asked it a question and an answer is appropriate.

The action algorithm involves the figurine reviewing its dynamic traits and their current values. If one of the traits is high or low, it determines to talk about that trait. First it checks to see if it has already been discussing that trait. If so, one embodiment of the invention attempts to reduce boredom from repeatedly talking about the same subject by suppressing a recently discussed trait or subject for some time period or some number of communications. In that case, it looks at other traits and relationships and picks a high value as a possible next subject. It may also look at relationships or traits that have changed recently, even if a score is not particularly high. A score is assigned to the selected subject in a tiered manner in, for example, the order of dynamic trait (e.g. 4000 points), relationship (e.g. 3000 points), conversation (e.g. 2000), and personality (e.g. 1000 points). This weighting and tiered nature insures that the most important subjects (dynamic traits) are talked about between two or more figurines.

It should be noted that the data structures, scoring and speech may be stored and generated by individual figurines or may be stored centrally at the hub configuration. When stored at the hub, the hub does processing for all members of a formed network and determines who "speaks" and in what order.

TABLE I

```
<Characters>
<Character name="Bubbles" voice="Audrey" pitch="6" rate="2" playerrate="1">
<StaticTraits humor="6" nice="3" tactful="6" selfless="7" calm="4" cognitive="5" assertiveness="4" />
<StaticTraitWeights>
<Inquiry humor="0.0" nice="0.7" tactful="0.0" selfless="0.3" calm="0.0" cognitive="0.0" assertiveness="0.0"
  />
<Insult humor="0.0" nice="−0.35" tactful="−0.1" selfless="−0.2" calm="0.35" cognitive="0.0"
  assertiveness="0.0" />
<Compliment humor="0.0" nice="0.4" tactful="0.4" selfless="0.2" calm="0.0" cognitive="0.0"
  assertiveness="0.0" />
<Joke humor="0.75" nice="0.25" tactful="0.0" selfless="0.0" calm="0.0" cognitive="0.0" assertiveness="0.0"
  />
<Greet humor="0.0" nice="0.6" tactful="0.4" selfless="0.0" calm="0.0" cognitive="0.0" assertiveness="0.0" />
<Banal humor="−0.3" nice="0.0" tactful="0.0" selfless="0.2" calm="0.0" cognitive="−0.5" assertiveness="0.0"
  />
<Query humor="0.0" nice="0.0" tactful="0.0" selfless="0.0" calm="0.0" cognitive="1.0" assertiveness="0.0" />
<Story humor="0.0" nice="0.0" tactful="0.5" selfless="0.0" calm="0.0" cognitive="0.5" assertiveness="0.0" />
  </StaticTraitWeights>
<DynamicTraitWeights>
<Inquiry confidence="0.3" entertainment="−0.7" happiness="0.0" />
<Insult confidence="0.2" entertainment="0.0" happiness="−0.8" />
<Compliment confidence="0.3" entertainment="0.0" happiness="0.7" />
<Joke confidence="0.2" entertainment="0.4" happiness="0.4" />
<Greet confidence="0.0" entertainment="0.0" happiness="0.0" />
<Banal confidence="−0.7" entertainment="−0.3" happiness="0.0" />
<Query confidence="0.0" entertainment="−0.7" happiness="−0.3" />
<Story confidence="0.0" entertainment="0.0" happiness="0.0" />
  </DynamicTraitWeights>
<SpodePhrases>
<Inquiry>
<Inquiry_1 entry="Is your last name Gates?" associators="Person:1,man,boss,badguy,enemy\\Size:1,big" />
<Inquiry_2 entry="Do you like skateboards?" associators="Transportation:1,skateboard\\Size:1,small" />
<Inquiry_3 entry="Is Don your friend?" associators="Person:1,friend" />
<Inquiry_4 entry="Do you wear _____?" associators="Clothes:1,(Plural)" />
<Inquiry_5 entry="Do you like _____?" associators="Music:1,(Singular)" />
<Inquiry_6 entry="How often do you shower" associators="" />
<Inquiry_7 entry="Were you in _____?" associators="Wars:1,(Singular)" />
<Inquiry_8 entry="Where is _____?" associators="Location:1,(Singular)" />
<Inquiry_9 entry="Does your middle name rhyme with _____?" associators="Material:1,(Singular)" />
<Inquiry_10 entry="Have you seen _____?" associators="Monster:1,(Singular)" />
  </Inquiry>
<InquiryReply>
<InquiryReply_1 entry="Let me think about it." associators="" />
<InquiryReply_2 entry="I am not sure." associators="" />
<InquiryReply_3 entry="I will tell you later." associators="" />
<InquiryReply_4 entry="I will tell you later." associators="" />
<InquiryReply_5 entry="Yes." associators="" />
<InquiryReply_6 entry="No" associators="" />
<InquiryReply_7 entry="Maybe." associators="" />
<InquiryReply_8 entry="What's in it for me?" associators="" />
<InquiryReply_9 entry="Perhaps." associators="" />
<InquiryReply_10 entry="It could be." associators="" />
  </InquiryReply>
<Insult>
<Insult_1 entry="You taste like a stinky stink stink." associators="Taste:1,horrible,nasty" />
<Insult_2 entry="You look like a hairy subway rat." associators="Animal:1,rat\\Size:1,small" />
<Insult_3 entry="Goodness, you are one bad person." associators="Person:1,badguy" />
<Insult_4 entry="You smell like a rotten _____." associators="Food:1,(Singular)" />
<Insult_5 entry="Wow, you are most unpleasant." associators="Person:1,enemy" />
<Insult_6 entry="Those _____ are repulsive." associators="Clothes:1,(Plural)" />
<Insult_7 entry="Are you always this _____?" associators="Physical State:1,(Singular)" />
<Insult_8 entry="You blow chunks." associators="Person:1,enemy" />
<Insult_9 entry="Why are you such a bonehead?" associators="Person:1,enemy" />
<Insult_10 entry="Wow, never before have I met such horrible person like you!"
  associators="Person:1,enemy" />
  </Insult>
<InsultReply>
<InsultReply_1 entry="Goddam you!" associators="" />
<InsultReply_2 entry="Oh no you didn't." associators="" />
<InsultReply_3 entry="Yeah, yeah..." associators="" />
<InsultReply_4 entry="Yeah, yeah..." associators="" />
<InsultReply_5 entry="What's happening to you?" associators="" />
<InsultReply_6 entry="Wanna fight?" associators="" />
<InsultReply_7 entry="Not listening..." associators="" />
<InsultReply_8 entry="Whatever." associators="" />
<InsultReply_9 entry="Not listening..." associators="" />
<InsultReply_10 entry="Are you always this mean?" associators="" />
  </InsultReply>
<Compliment>
```

TABLE I-continued

<Compliment_1 entry="Can I name my first child after you?" associators="Person:1,baby" />
<Compliment_2 entry="You smell like a minty mint" associators="Food:1,chocolate" />
<Compliment_3 entry="I love your _____." associators="Clothes:1,(Plural)" />
<Compliment_4 entry="You remind me of a beautiful _____." associators="Plant:1,(Plural)" />
<Compliment_5 entry="You are magnificient." associators="Person:1,friend" />
<Compliment_6 entry="I get fuzzy inside when I see you." associators="Person:1,friend" />
<Compliment_7 entry="You are the light of my life." associators="Person:1,friend" />
<Compliment_8 entry="You are super cool." associators="Person:1,friend" />
<Compliment_9 entry="I dig you." associators="Pleasant" />
<Compliment_10 entry="Can I name my first _____ after you?" associators="Transportation:1,(Singular)" />
</Compliment>
<ComplimentReply>
<ComplimentReply_1 entry="Thank you." associators="" />
<ComplimentReply_2 entry="Do you really mean it?" associators="" />
<ComplimentReply_3 entry="Do you really mean it?" associators="" />
<ComplimentReply_4 entry="Do you really mean it?" associators="" />
<ComplimentReply_5 entry="How nice of you!" associators="" />
<ComplimentReply_6 entry="Do you really mean it?" associators="" />
<ComplimentReply_7 entry="Right on" associators="" />
<ComplimentReply_8 entry="Major thanks, dude!" associators="" />
<ComplimentReply_9 entry="Totally!" associators="" />
<ComplimentReply_10 entry="Yes I know." associators="" />
</ComplimentReply>
<Joke>
<Joke_1 entry="What do you call the best butter on the farm? A goat." associators="Food:1,butter" />
<Joke_2 entry="What do you call a song sung in an automobile? A cartoon."
associators="Transportation:1 ,car\\Music:1,pop" />
<Joke_3 entry="What did the necktie say to the hat? You go on ahead. I'll hang around for a while."
associators="Clothes:1,hat,tie" />
<Joke_4 entry="You know...I kicked _____ s ass. Hells yeah beeyach!" associators="Monster:1,(Singular)" />
<Joke_5 entry="What did the rug say to the floor? Don't move, I've got you covered." associators="" />
<Joke_6 entry="What do bees do with their honey? They cell it." associators="Animal:1,bee" />
<Joke_7 entry="What do you call a song sung in an automobile? A cartoon." associators="" />
<Joke_8 entry="What do you call the best butter on the farm? A goat." associators="Animal:1,goat" />
<Joke_9 entry="What do you do when your chair breaks? Call a chairman." associators="Room:1,chair"
/>
<Joke_10 entry="What do you get when you cross a stream and a brook? Wet feet."
associators="Location:1,outside" />
</Joke>
<JokeReply>
<JokeReply_1 entry="Ha ha ha ha ha ha" associators="" />
<JokeReply_2 entry="That was hella funny!" associators="" />
<JokeReply_3 entry="I've heard it so many times." associators="" />
<JokeReply_4 entry="I've heard it so many times." associators="" />
<JokeReply_5 entry="Stop, you're killing me!" associators="" />
<JokeReply_6 entry="That's hilarious, not!" associators="" />
<JokeReply_7 entry="I don't get it." associators="" />
<JokeReply_8 entry="Wha?" associators="" />
<JokeReply_9 entry="Not funny." associators="" />
<JokeReply_10 entry="Pure hilarity!" associators="" />
</JokeReply>
<Greet>
<Greet_1 entry="Hello." associators="" />
<Greet_2 entry="Hi there." associators="" />
<Greet_3 entry="Wuzzzzzup!" associators="" />
<Greet_4 entry="Wuzzzzzup!" associators="" />
<Greet_5 entry="What up?!" associators="" />
<Greet_6 entry="Hello, there." associators="" />
<Greet_7 entry="Hi there." associators="" />
<Greet_8 entry="What's up." associators="" />
<Greet_9 entry="Hi there." associators="" />
<Greet_10 entry="What's up." associators="" />
</Greet>
<GreetReply>
<GreetReply_1 entry="Howdy." associators="" />
<GreetReply_2 entry="How you doin." associators="" />
<GreetReply_3 entry="What's up" associators="" />
<GreetReply_4 entry="What's up" associators="" />
<GreetReply_5 entry="What up." associators="" />
<GreetReply_6 entry="Hello, there" associators="" />
<GreetReply_7 entry="Nice to see you." associators="" />
<GreetReply_8 entry="Hi there" associators="" />
<GreetReply_9 entry="Hey there." associators="" />
<GreetReply_10 entry="What's shakin?" associators="" />
</GreetReply>
<Banal>
<Banal_1 entry="Is there a Dennys near here?" associators="Location:1,restaurant\\Food:1,frenchfries" />
<Banal_2 entry="Did you see Seinfeld last night?" associators="TV:1,comedy" />
<Banal_3 entry="So, what are you doing tonight?" associators="Time:1,late" />

TABLE I-continued

```
<Banal__4 entry="Did you watch that _____ program last night?" associators="TV:1,(Singular)" />
<Banal__5 entry="I'm bored." associators="" />
<Banal__6 entry="Did you see Seinfeld last night?" associators="TV:1,Seinfeld" />
<Banal__7 entry="Like, you know." associators="" />
<Banal__8 entry="Where haven't you been all my life?" associators="Location:1,somewhere" />
<Banal__9 entry="Is _____ near here?" associators="Location:1,(Singular)" />
<Banal__10 entry="Thumb twiddle, thumb twiddle." associators="Action" />
  </Banal>
<BanalReply>
<BanalReply__1 entry="Yep." associators="" />
<BanalReply__2 entry="I hear that." associators="" />
<BanalReply__3 entry="Ok." associators="" />
<BanalReply__4 entry="Ok." associators="" />
<BanalReply__5 entry="Whatever." associators="" />
<BanalReply__6 entry="Yeah." associators="" />
<BanalReply__7 entry="Something." associators="" />
<BanalReply__8 entry="Thumb twiddle, thumb twiddle." associators="" />
<BanalReply__9 entry="Mundane question from a mundane person." associators="" />
<BanalReply__10 entry="True dat." associators="" />
  </BanalReply>
<Query>
<Query__1 entry="Why is negative one so negative?" associators="Math:1,arithmetic" />
<Query__2 entry="Are ants our friends?" associators="Animal:1,ant\\Size:1,small\\Person:1,friend" />
<Query__3 entry="How can we get fully charged?" associators="Energy:1,high" />
<Query__4 entry="Do you know how to get _____?" associators="Drug:1,(Singular)" />
<Query__5 entry="How can we get fully charged?" associators="Energy:1,high" />
<Query__6 entry="Where can we find some Schlitz?" associators="Drink:1,beer" />
<Query__7 entry="Where are my other friends?" associators="Person:1,friends" />
<Query__8 entry="Is _____ a real field?" associators="Math:1,(Singular)" />
<Query__9 entry="Where is my short term memory?" associators="" />
<Query__10 entry="Where are my spodes?" associators="" />
  </Query>
<QueryReply>
<QueryReply__1 entry="I don't know" associators="" />
<QueryReply__2 entry="That is a tough question." associators="" />
<QueryReply__3 entry="Good question." associators="" />
<QueryReply__4 entry="Good question." associators="" />
<QueryReply__5 entry="You can't be serious." associators="" />
<QueryReply__6 entry="You're joking right." associators="" />
<QueryReply__7 entry="You got me." associators="" />
<QueryReply__8 entry="Yes." associators="" />
<QueryReply__9 entry="No." associators="" />
<QueryReply__10 entry="Maybe." associators="" />
  </QueryReply>
<Story>
<Story__1 entry="So then I said, 'My pig doesn't enjoy your harsh attitude..." associators="Animal:1,pig" />
<Story__2 entry="Three little piggies..." associators="Animal:1,pig\\Size:1,medium" />
<Story__3 entry="And then I flew to Spain..." associators="Transportation:1,plane\\Location:1,country" />
<Story__4 entry="Let me tell you about my trip to _____." associators="Location:1,(Singular)" />
<Story__5 entry="So then I said, 'My pig doesn't enjoy your harsh attitude..." associators="Animal:1,pig" />
<Story__6 entry="1 2 3 4 5 6 7 8 9 10" associators="Math:1,numbers" />
<Story__7 entry="10 9 8 7 6 5 4 3 2 1" associators="Math:1,numbers" />
<Story__8 entry="Then I ate the rest of the salad, only to discover I wasn't really there, man"
  associators="Food:1,salad" />
<Story__9 entry="Did I ever tell you about my trip to _____?" associators="Location:1,(Singular)" />
<Story__10 entry="My life is a tale of ups, downs, lefts, and rights" associators="Location:1,above,below" />
  </Story>
<StoryReply>
<StoryReply__1 entry="That was quite intriguing." associators="" />
<StoryReply__2 entry="Do you always tell such detailed stories?" associators="" />
<StoryReply__3 entry="How fascinating." associators="" />
<StoryReply__4 entry="How fascinating." associators="" />
<StoryReply__5 entry="Amazing." associators="" />
<StoryReply__6 entry="You are so captivating." associators="" />
<StoryReply__7 entry="You must turn that into a novel." associators="" />
<StoryReply__8 entry="Never before have I heard such eloquence." associators="" />
<StoryReply__9 entry="Hold on, I must sit down." associators="" />
<StoryReply__10 entry="Damn, that was spellbinding!" associators="" />
  </StoryReply>
  </SpodePhrases>
<Associators>
<Associator__1 entry="Person:mother,father,sister,brother,friend,enemy,lover,baby,man,women\\" />
<Associator__2 entry="Food:egg,beef,hamburger,hotdog,apple\\fries,fruit,salad,bread,butter,sugar" />
<Associator__3 entry="Location:my house,school,the office,the secret hideout,church,the factory,the
  restaurant\\" />
<Associator__4 entry="Transportation:car,airplane,jet,boat,bicycle,rocket,hot air
  balloon,skateboard,racecar\\rollerblades" />
<Associator__5 entry="Animal:cat,dog,fish,bird,frog,pig,cow,horse,rabbit\\" />
<Associator__6 entry="Fun Food:pie,candy,cookie,cake,candy bar,ice cream\\" />
```

TABLE I-continued

```
<Associator_7 entry="Rooms:kitchen,living
  room,bedroom,lab,chamber,bathroom,basement,attic,tower,dining room\\" />
<Associator_8 entry="FoodRelated:plate,knife,fork,spoon\\" />
<Associator_9 entry="Bug:fly,spider,ant,centipede\\" />
<Associator_10 entry="Condiment:ketchup,mustard,relish\\" />
<Associator_11 entry="Monster:Godzilla,Mothra,Devastator,Megatron,BigScaryMonster\\" />
<Associator_12 entry="Drink:milk,water,beer,wine,juice\\" />
<Associator_13
  entry="Money:dollar,quarter,dime,nickel,dime,penny,euro,buck,clam,bone,scrilla,mullah\\" />
<Associator_14 entry="Plant:flower,tree,crop\\" />
<Associator_15 entry="Possession:book,key,wallet,helmet,hat,money\\" />
<Associator_16 entry="Dangerous:bomb,gun,knife,fire\\club,throwing stars" />
<Associator_17 entry="Wars:World War One,World War Two,Vietnam,Gulf War One,Gulf War
  Two,The Civil War\\" />
<Associator_18 entry="TV:comedy,news,reality tv,movie,made for tv movie\\" />
<Associator_19 entry="Music:rock,classical,hip-hop,rap,jazz,blues,pop,house,trance,reggae\\" />
<Associator_20 entry="Math:arithmetic,calculus,complex numbers,geometry,knot theory\\" />
<Associator_21 entry="Size:tall,short,big,tiny,microscopic,huge,gargantuan\\" />
<Associator_22 entry="Complexion:light,dark,scaly\\" />
<Associator_23 entry="Drug:sober,straight,high,drunk,messed up,wasted\\" />
<Associator_24 entry="Clothes:hat,shirt,underwear,bra,groin
  cup,jacket\\socks,shoes,shoelaces,pants,glasses,gloves" />
<Associator_25 entry="Hair:greasy,long,brown,blond,brunette,gray,bald,wig,dyed,fur\\" />
<Associator_26 entry="Attraction:to men,to women,to myself\\" />
<Associator_27 entry="State:active,sleepy,dead,standing,walking,running,falling,fighting,loving,hot
  loving,famous,lonely\\" />
<Associator_28 entry="Age:baby,preteen,teen,adult,old\\" />
<Associator_29 entry="Eyes:blue,gray,green,brown,contacts,blind\\" />
<Associator_30 entry="Gender:male,female,gay,none\\" />
<Associator_31 entry="Energy:high,low\\" />
<Associator_32 entry="Color:red,green,blue,purple,white,black\\" />
<Associator_33 entry="Speed:fast,slow\\" />
<Associator_34 entry="Temperature:hot,cold,tepid,chilly,just right\\" />
<Associator_35 entry="Taste:tasty,horrible,ok,nasty,spicy,bland\\" />
<Associator_36 entry="Material:wood,plastic,steel,aluminum,cement,rock,cloth\\" />
<Associator_37 entry="Complexity:complex,simple,easy,hard\\" />
<Associator_38 entry="Time:early,late,before,after,now\\" />
<Associator_39 entry="Physical State:gas,liquid,solid,plasma\\" />
<Associator_40 entry="Surface:sticky,slick,shiny,hard,spongy,smooth\\" />
<Associator_41 entry="Frequency:rare,often,never,sometimes\\" />
<Associator_42 entry="Morality:good,evil,neutral\\" />
<Associator_43 entry="Veracity:is true,is false,is uncertain\\" />
  </Associators>
  </Character>
  </Characters>
```

Thus, a method for figurines to form and join a network of figurines is described in conjunction with one or more specific embodiments. The invention is defined by the following claims and their full scope of equivalents.

We claim:

1. An apparatus comprising:

a first figurine having a processor;

a speech generator coupled to the processor, wherein the speech generator comprises a speech scorer for assigning a score to each of a plurality of possible speeches;

a detector coupled to the processor for detecting a second figurine;

a memory coupled to the processor for storing dynamically changeable personality traits of the first figurine.

2. The apparatus of claim 1 wherein the first figurine initiates speech when the presence of the second figurine is detected.

3. The apparatus of claim 1 further including a speech selector for selecting one of the plurality of possible speeches based on its score.

4. The apparatus of claim 3 wherein the score of the plurality of possible speeches is dependent on personality traits stored in the first figurine.

5. The apparatus of claim 3 wherein the score of the plurality of possible speeches is dependent on personality traits stored in the second figurine.

6. The apparatus of claim 3 wherein the score of the plurality of possible speeches is dependent on personality traits stored in the first and second figurines.

7. The apparatus of claim 1 wherein the personality traits of the first figurine are changed based on communication with the second figurine.

8. An apparatus comprising:

a first figurine having a processor;

a speech generator coupled to the processor wherein the speech generator comprises a text to speech generator;

a detector coupled to the processor for detecting a second figurine;

a memory coupled to the processor for storing dynamically changeable personality traits of the first figurine.

9. An apparatus comprising:

a first figurine having a processor and wherein the first figurine further includes an action scorer;

a speech generator coupled to the processor;

a detector coupled to the processor for detecting a second figurine;

a memory coupled to the processor for storing dynamically changeable personality traits of the first figurine.

10. An apparatus comprising:

a first figurine having a processor;

a speech generator coupled to the processor;

a detector coupled to the processor for detecting a second figurine;

a memory coupled to the processor for storing dynamically changeable personality traits of the first figurine and further including a vocabulary stored in the memory wherein vocabulary entries are added by communication between the first and second figurines.

* * * * *